US009674924B2

(12) United States Patent
Lashina et al.

(10) Patent No.: US 9,674,924 B2
(45) Date of Patent: Jun. 6, 2017

(54) METHODS AND APPARATUS FOR CONTROL OF ILLUMINATION IN AN INTERIOR SPACE

(71) Applicant: PHILIPS LIGHTING HOLDING B.V., Eindhoven (NL)

(72) Inventors: Tatiana Aleksandrovna Lashina, Eindhoven (NL); Bartel Marinus Van De Sluis, Eindhoven (NL); Giovanna Wagenaar Cacciola, Eindhoven (NL); Berent Willem Meerbeek, Eindhoven (NL); Dennis Van De Meulenhof, Helmond (NL); Gerardus Henricus Adrianus Johannes Broeksteeg, Veldhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 86 days.

(21) Appl. No.: 14/353,901

(22) PCT Filed: Oct. 9, 2012

(86) PCT No.: PCT/IB2012/055444

§ 371 (c)(1),
(2) Date: Apr. 24, 2014

(87) PCT Pub. No.: WO2013/061189

PCT Pub. Date: May 2, 2013

(65) Prior Publication Data

US 2014/0292206 A1 Oct. 2, 2014

Related U.S. Application Data

(60) Provisional application No. 61/551,246, filed on Oct. 25, 2011.

(51) Int. Cl.
*H05B 37/02* (2006.01)

(52) U.S. Cl.
CPC ..... *H05B 37/02* (2013.01); *H05B 37/029* (2013.01)

(58) Field of Classification Search
CPC .. H05B 37/02; H05B 37/029; H05B 37/0218; H05B 33/0854; H05B 33/0872;
(Continued)

(56) References Cited

U.S. PATENT DOCUMENTS 5,038,261 A 8/1991 Kloos
5,285,356 A 2/1994 Skene et al.
(Continued)

FOREIGN PATENT DOCUMENTS

CN 2726266 Y 9/2005
CN 1725925 A 1/2006
(Continued)

*Primary Examiner* — Haissa Philogene

(57) ABSTRACT

Methods and apparatus related to controlling illumination in a space. The method may include determining a heading of a daylight blocking element and/or a lighting fixture (301) and automatically adjusting at least one characteristic of the daylight blocking element and/or the lighting fixture based at least in part on the determined heading (305). The method may additionally or alternatively include proactively determining likely daylight conditions at a future time and beginning to adjust at least one characteristic of a daylight blocking element and/or a lighting fixture prior to the future time (202/203). Daylight blocking elements and/or lighting fixtures are also provided that may facilitate one or more aspect of the methods of controlling illumination.

14 Claims, 2 Drawing Sheets

(58) Field of Classification Search
CPC ..... H05B 37/0227; F21S 11/007; F24J 2/40; F24J 2/407; Y02B 20/46; Y02B 20/48
USPC ..... 315/149, 159, 297, 312, 307; 318/471, 318/480
See application file for complete search history.

(56) References Cited

U.S. PATENT DOCUMENTS

| | | | | |
|---|---|---|---|---|
| 5,343,121 | A | 8/1994 | Terman et al. | |
| 5,598,000 | A | 1/1997 | Popat | |
| 6,084,231 | A | 7/2000 | Popat | |
| 6,098,893 | A | 8/2000 | Berglund et al. | |
| 6,551,439 | B1 | 4/2003 | Hill, IV et al. | |
| 7,202,613 | B2 * | 4/2007 | Morgan | A01M 1/04 315/312 |
| 7,978,222 | B2 * | 7/2011 | Schneider | G03B 17/00 348/208.1 |
| 8,376,600 | B2 * | 2/2013 | Bartol | E04D 13/03 359/597 |
| 9,210,768 | B2 * | 12/2015 | Adler | H05B 33/0857 |
| 9,370,079 | B2 * | 6/2016 | Lashina | H05B 33/0872 |
| 2005/0110416 | A1 | 5/2005 | Veskovic | |
| 2005/0116667 | A1 | 6/2005 | Mueller et al. | |
| 2006/0207730 | A1 | 9/2006 | Berman et al. | |
| 2006/0285323 | A1 | 12/2006 | Fowler | |
| 2009/0222137 | A1 | 9/2009 | Berman et al. | |
| 2010/0084996 | A1 | 4/2010 | Van De Sluis et al. | |
| 2010/0231140 | A1 | 9/2010 | Aarts | |
| 2010/0287830 | A1 | 11/2010 | Chen et al. | |
| 2011/0019388 | A1 | 1/2011 | Cao et al. | |
| 2011/0084614 | A1 | 4/2011 | Eisele et al. | |
| 2015/0084513 | A1 * | 3/2015 | Anthony | H05B 37/0245 315/131 |
| 2015/0085475 | A1 * | 3/2015 | Ryu | F21S 8/026 362/147 |

FOREIGN PATENT DOCUMENTS

| | | | |
|---|---|---|---|
| JP | 5121176 | A | 5/1993 |
| JP | 7065963 | A | 3/1995 |
| JP | 2001167607 | A | 6/2001 |
| JP | 2001176679 | A | 6/2001 |
| JP | 2010526405 | A | 7/2010 |
| WO | 2006129238 | A2 | 12/2006 |
| WO | WO 2010135582 | A2 | 11/2010 |

* cited by examiner

METHODS AND APPARATUS FOR CONTROL OF ILLUMINATION IN AN INTERIOR SPACE

TECHNICAL FIELD

The present invention is directed generally to control of illumination. More particularly, various inventive methods and apparatus disclosed herein relate to control of natural daylight and/or artificial light in an interior space.

BACKGROUND

Control of illumination within an interior space may utilize a natural daylight management system. Some natural daylight management systems utilize shading near a window or other light passageway in optical communication with natural daylight to alter the amount and/or type of daylight that is directed into the room. For example, automated blinds may be selectively actuated to minimize glare from sunlight in an interior space. Also, for example, some daylight management systems may utilize light guiding systems to direct exterior daylight (diffusely, directly, and/or via collection and transportation) to an interior area. However, known daylight management systems suffer from one or more drawbacks. For example, conventional daylight management elements do not adjust in correspondence with detected orientation information of the daylight management element. Also, for example, current daylight management elements do not proactively adjust based on short-term weather-based information.

Control of illumination within an interior space may additionally or alternatively employ an artificial daylight system that attempts to mimic natural daylight. Artificial daylight systems have been implemented in large buildings and/or urban areas in which many spaces have only limited access to natural daylight. Some known artificial daylight systems are configured to mimic natural daylight conditions with varying degrees of accuracy. For example, some artificial daylight systems mimic changes in color temperature and light intensity throughout the day in synch with typical daylight patterns. However, conventional artificial daylight elements suffer from one or more drawbacks. For example, artificial daylight elements do not adjust the direction or other characteristic of light output in correspondence with detected orientation information of the artificial daylight element. Also, for example, daylight elements do not adjust light output based on short-term weather-based information. As a result, these known artificial daylight systems are typically unable to accurately reproduce contemporaneous daylight conditions for their geographic location, instead generating lighting effects which are inconsistent with lighting effects from either other artificial daylight elements in the same space or building, or from actual daylight in the space. It common for end users to experience both real daylight and mimicked daylight effects simultaneously. In those instances, if the direction, intensity, color temperature and other lighting characteristics from various light sources are inconsistent or in conflict, the resulting combined illumination may disorientate the user or make the artificial lighting effect look unrealistic or unpleasant.

Thus, there is a need in the art to provide systems and methods that control natural daylight and/or artificial light in a space and that optionally overcome one or more drawbacks of existing approaches.

SUMMARY

The present disclosure is directed to inventive methods and apparatus for controlling natural daylight and/or artificial light in an interior space. For example, a method of controlling illumination in a space may involve determining a heading of a daylight blocking element and/or a lighting fixture and automatically adjusting at least one characteristic of the daylight blocking element and/or the lighting fixture based at least in part on the determined heading. Also, for example, a method of controlling illumination in an interior space may additionally or alternatively involve proactively determining likely daylight conditions at a future time and adjusting at least one characteristic of a daylight blocking element and/or a lighting fixture prior to the future time. Daylight blocking elements and/or lighting fixtures are also provided that may facilitate one or more aspect of the methods of controlling illumination.

Generally, in one aspect, the invention relates to a method of controlling illumination in a space and includes the step of determining a heading of at least one of a daylight blocking element and a lighting fixture utilizing a sensor of the at least one of the daylight blocking element and the lighting fixture. The method also includes the steps of: determining a geographic location of the at least one of the daylight blocking element and the lighting fixture; determining at least one climate-related parameter for the geographic location; and adjusting at least one characteristic of the at least one of the daylight blocking element and the lighting fixture based on the heading and the climate-related parameter.

In some embodiments, the at least one characteristic includes a light output direction of the lighting fixture. In other embodiments, the at least one characteristic includes a light output distribution shape of the lighting fixture. In yet other embodiments, the at least one characteristic includes a rotational orientation of a plurality of louvers of the daylight blocking element.

In some embodiments, the heading is determined via a sensor on the at least one of the daylight blocking element and the lighting fixture.

In some embodiments, the climate-related parameter includes short-term weather-based information. In some versions of those embodiments the method further includes the step of proactively determining, based on the short-term weather-based information, likely daylight conditions in an exterior space relative to the interior space at a future time; and wherein the at least one characteristic of the at least one of the daylight blocking element and the lighting fixture is adjusted in correspondence with the likely daylight conditions prior to the future time.

In some embodiments, the method further includes the step of determining at least one of a pitch and a yaw of the at least one of the daylight blocking element and the lighting fixture. The at least one characteristic of the daylight blocking element and the lighting fixture are adjusted in correspondence with the at least one of the pitch and the yaw. In some versions of those embodiments, the sensor determines the at least one of the pitch and the yaw.

Generally, in another aspect, a method of controlling illumination in a space, includes the steps of: receiving short-term weather-based information; proactively determining, based on the short-term weather-based information, likely daylight conditions in an exterior space relative to the space at a future time; and beginning to adjust at least one characteristic of at least one of a daylight blocking element and a lighting fixture in correspondence with the likely daylight conditions prior to the future time.

In some embodiments, the adjusting step includes adjusting the at least one characteristic of the daylight blocking element and adjusting the at least one characteristic of the lighting fixture. The short-term weather-based information may include cloud cover information and/or information related to daylight level from a location near the exterior space, as well as wind strength, and wind direction.

In some embodiments, the adjusting step includes beginning to adjust the at least one characteristic of the daylight blocking element at least thirty seconds prior to the future time.

In some embodiments, the adjusting step includes beginning to adjust the at least one characteristic of the lighting fixture at least thirty seconds prior to the future time.

In some embodiments, the adjusting step is substantially completed prior to the future time.

In some embodiments, the at least one characteristic of the daylight blocking element includes adjusting the deployment level of a diffusing window covering.

In some embodiments, the lighting fixture is a LED-based multi-directional lighting fixture.

Generally, in another aspect, a lighting fixture is provided having a heading sensor generating heading data, a geographic location source providing geographic location data, a controller, and a light source generating a light output. The controller receives at least one climate-related parameter for the geographic location. The controller alters at least one characteristic of the light output based on the heading data and the climate-related parameter.

In some embodiments, the at least one characteristic includes a light output direction of the light output. In other embodiments the at least one characteristic includes a light output shape of the light output. In still other embodiments, the climate-related parameter includes short-term weather-based information.

In some embodiments, the heading sensor is a three axis electronic sensor also generating at least one of pitch and yaw data.

Generally, in another aspect, the invention relates to a daylight blocking element having a geographic location source providing geographic location data, a controller, and an actuable window covering. The controller receives short-term weather-based information for the geographic location and proactively determines, based on the short-term weather-based information, likely daylight conditions in an exterior space at a future time. The controller is coupled to the actuable window covering and actuates the window covering in correspondence with the likely daylight conditions prior to the future time.

In some embodiments, the daylight blocking element further includes a heading sensor and the controller actuates the window covering based at least in part on output from the heading sensor.

In some embodiments, the window covering includes a plurality of louvers mechanically coupled to a motor activated by the controller. The window covering may include an electrochromic device actuated by the controller.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyroluminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources and/or daylight blocking elements. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Control of illumination within an interior space may utilize a natural daylight management system that alters the amount and/or type of natural daylight that is directed into the room. However, current daylight management systems do not include elements that adjust in correspondence with detected orientation information of the daylight management element and do not anticipatorily adjust based on short-term weather-based information.

Control of illumination within an interior space may also utilize an artificial daylight system that attempts to mimic natural daylight. However, current artificial daylight systems do not include elements that adjust the direction or other characteristic of light output in correspondence with detected orientation information of the artificial daylight element and do not adjust light output based on short-term weather-based information.

Thus, Applicants have recognized and appreciated a need to provide systems and methods that control natural daylight and/or artificial light in an interior space with improved accuracy and that optionally overcome one or more drawbacks of existing technology.

In view of the foregoing, various embodiments and implementations of the present invention are directed to control of illumination in a space.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. Such methods and apparatus are clearly within the scope of the claimed invention. For example, various embodiments of the approach disclosed herein are discussed in conjunction with a control system that controls one or more characteristics of a daylight blocking element and one or more characteristics of a daylight mimicking lighting fixture. However, other configurations and applications of this approach are contemplated without deviating from the scope or spirit of the claimed invention. For example, in some applications the approach may be implemented in conjunction with a control system that controls one or more daylight mimicking lighting fixtures but that does not control any daylight blocking elements, or vice versa.

Figure 1A:
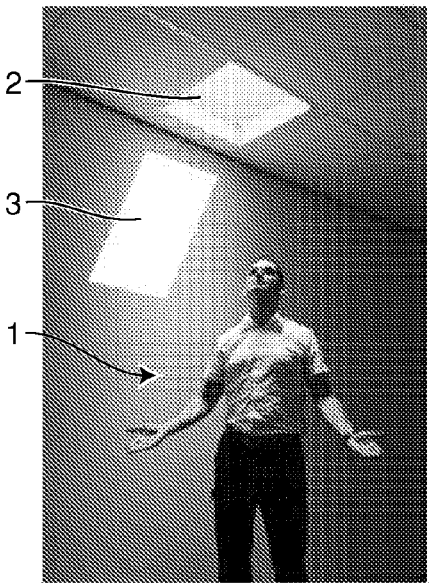
FIG. 1A illustrates an individual standing below a first embodiment of a daylight mimicking lighting fixture.

Referring to FIG. 1A, an individual 1 is illustrated standing below a first embodiment of a daylight mimicking lighting fixture 2. The daylight mimicking lighting fixture 2 is installed as a faux skylight and directs a light output 3 primarily at a wall. As described in detail herein, the light output 3 may be configured such that it substantially corresponds to actual daylight effects at the geographic location of the lighting fixture 2. For example, the beam direction, beam shape, color temperature, intensity, and/or thermal temperature of the light output 3 may be configured to substantially correspond to actual daylight effects at the geographic location. In some implementations, the daylight mimicking lighting fixture 3 may employ a LED-based light source and one or more of color temperature, direction, beam shape, intensity, and/or thermal temperature of the light output of the LED-based light source may be adjusted. For example, direction of the LED-based light source may be altered utilizing a motor that actuates a surface supporting one or more of the LEDs or other light source, by selectively activating certain subsets of a LED array or other light source, by moving optical elements over one or more LEDs or other light source, and/or by rotating or otherwise altering the orientation of one or more optical elements provided over one or more LEDs or other light source.

Although a skylight lighting fixture 2 located in a building is illustrated in FIG. 1A, it is understood that the methods and apparatus described herein are applicable to other daylight mimicking lighting fixtures that may optionally be in other locations. For example, daylight mimicking windows, doors, and/or other lighting fixtures may be provided in buildings, planes, vehicles, nautical vessels, container hotels, parasols, tents, and/or light therapy devices. Also, for example, in some embodiments lighting fixtures that are not daylight mimicking may be provided that still adjust light output based upon one or more of short-term weather conditions, and heading, pitch, and/or yaw of the lighting fixture.

Figure 1B:
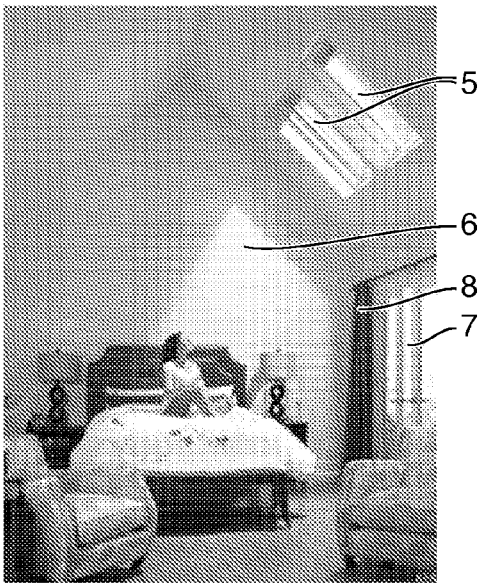
FIG. 1B illustrates an individual sitting below a second embodiment of a daylight mimicking lighting fixture and in front of a daylight blocking element.

Referring to FIG. 1B, an individual 4 is illustrated sitting below a second embodiment of a daylight mimicking lighting fixture 5. The daylight mimicking lighting fixture 5 is installed as a pair of skylights in a sloped ceiling and directs a light output 6 in a generally downward direction toward the individual 4. The light output 6 may also be configured such that it substantially corresponds to actual daylight effects at the geographic location of the lighting fixture 5. Also illustrated in FIG. 1B is a door 7 having light output openings therein. A window covering 8 is also illustrated in a substantially open position. As described in detail herein, the window covering 8 may be configured such that its positioning and/or status substantially corresponds to actual daylight effects at its geographic location (e.g., closed when daylight is bright to reduce glare). For example, the extent to which the window covering 8 extends across the door 7 may be configured to substantially correspond to actual daylight effects at the geographic location. Also, for example, the window covering 8 may be a multi-layered window covering 8 and the number of layers that are deployed (and optionally the extent of deployment) at a given time may be configured to substantially correspond to actual daylight effects at the geographic location.

Although a specific window covering 8 located in a building in front of a door 7 is illustrated in FIG. 1B, it is understood that the methods and apparatus described herein are applicable to other daylight blocking elements that may optionally be in other locations. For example, daylight blocking elements may include any type of covering for a daylight opening that facilitates control of solar glare, brightness, veiling glare, illuminance ratios, solar heat gain or loss, and/or UV exposure. Daylight blocking elements may specifically include any type of blinds, drapes, shades, Venetian blinds, vertical blinds, adjustable louvers or panels, fabric coverings, mesh, mesh coverings, window slats, and/or the like. Such daylight blocking elements may include various opening devices such as pull cords, drawstrings, ties, pulleys, levers, and/or any other type of device that is configured to facilitate opening, closing, moving, and/or otherwise varying the configuration of a daylight blocking element. The opening device may be coupled to a controllable motor for selectively actuating the opening device. As an example, a daylight blocking element may include a series of adjustable louvers provided over a window and control of the upper louvers may be independent from control of the lower louvers. The lower louvers may be positioned at a first rotational orientation to reduce perceived glare from daylight and the upper louvers may be positioned at a second rotational orientation to maximize illumination on the ceiling. Daylight blocking elements may also include one or more blocking elements utilized in smart windows such as electrochromic devices, photochromic devices, suspended particle devices, micro-blinds, and/or liquid crystal devices that may be electrically activated to one or more states to alter the light transmission properties of a window or other structure (e.g., between transparent and opaque; between transparent, translucent, and opaque; between translucent and opaque; between transparent and translucent).

Figure 2:
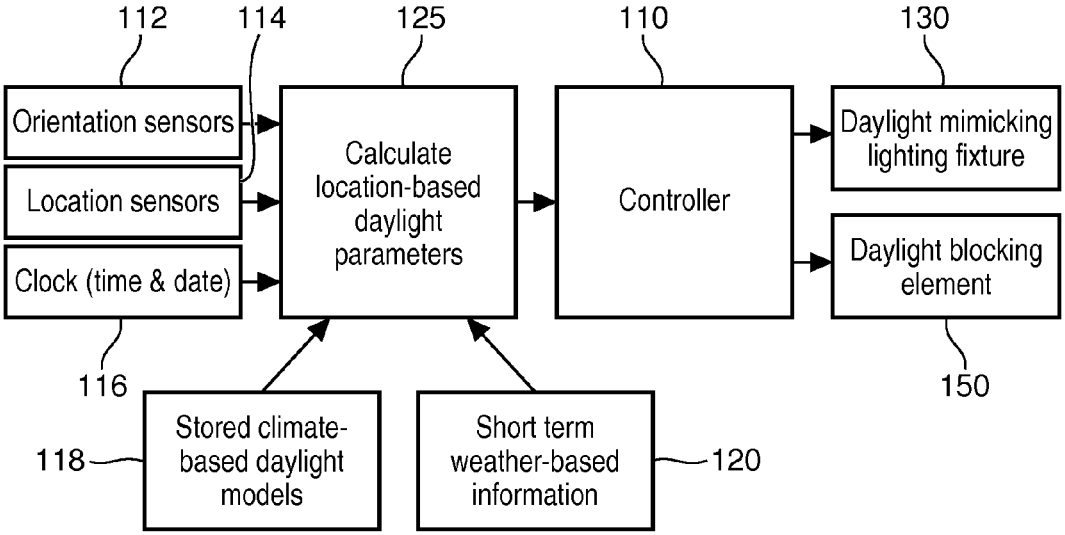
FIG. 2 illustrates a block diagram of a control system for a daylight mimicking lighting fixture and a daylight blocking element.

Referring to FIG. 2, a block diagram of a control system for a daylight mimicking lighting fixture 130 and a daylight blocking element 150 is illustrated. Although various components of the control system may be described as being utilized to control aspects of both the daylight mimicking lighting fixture 130 and the daylight blocking element 150, it is understood that in some embodiments one or more components may only control aspects of the daylight mimicking lighting fixture 130 or the daylight blocking element 150. For example, in some embodiments the daylight mimicking lighting fixture 130 and the daylight blocking element 150 are each stand alone fixtures that contain their own control components and do not share any common control components.

The control system includes orientations sensors 112. In some embodiments the daylight mimicking lighting fixture 130 includes an orientation sensor 112 and the daylight blocking element 150 includes a separate orientation sensor 112. Having an on-board orientation sensor enables sophisticated realistic control of lighting fixture 130 and/or daylight blocking element 150 without the necessity of manually commissions the lighting fixture 130 and/or daylight blocking element 150. The orientation sensor may sense one or more of a heading, a pitch, and a roll lighting fixture 130 and/or daylight blocking element 150. For example, the lighting fixture 130 and/or daylight blocking element 150 may generally define a plane and the heading, pitch, or roll of that plane relative to a nadir axis may be determined. Heading generally references the orientation of the particular element to the Earth's magnetic poles or the rotational orientation of the element about a nadir axis. Heading may be measured utilizing one or more sensors such as, for example, a digital compass (e.g., a magnetometer, gyrocompass, and/or hall effect sensors) that provides an electronic output indicative of orientation to Earth's magnetic poles. Pitch references the rotation of the particular element about a first axis perpendicular to the nadir axis and may be measured utilizing one or more sensors such as, for example, a gyroscope and/or an accelerometer. Roll references the rotation of the particular element about a third axis perpendicular to the nadir axis and the second axis and may be measured utilizing one or more sensors such as, for example, a gyroscope and/or an accelerometer. In some embodiments one or more of the orientation sensors only sense heading. Also, in some embodiments, a single orientation sensor may sense multiple of the heading, pitch, and roll. For example, a three-axis electronic compass may be utilized that can determine heading, pitch, and roll.

As described herein, the light output generated by the daylight mimicking lighting fixture 130 and/or the amount of daylight blocked and/or diffused by the daylight blocking element 150 may be based at least in part upon the detected orientation of the respective lighting fixture 130 and/or daylight blocking element 150. For example, the direction of the light output of the daylight mimicking lighting fixture 130 may be based upon its sensed heading. For example, data related to the relationship between apparent daily patterns of the sun and annual orbit of the sun may be utilized in combination with a determined date, time, and/or geographic location (and optionally in combination with weather-based information as described herein) to identify a likely actual direction and/or intensity of any generated sunlight that would be transmitted through the daylight mimicking lighting fixture 130 were it an actual light transmitting element directly exposed to the exterior. The direction of the light output may thus be adjusted to mimic likely actual direction of generated sunlight through a natural light transmissive element. Also, for example, other lighting fixtures may have light output adjusted depending on their heading and/or the heading of the daylight blocking element 150. For example, lighting fixtures that are adjacent a daylight blocking element 150 having a heading to the east may have their light output dimmed in the mornings to accommodate increased natural light entry into the interior area via the opening covered by the daylight blocking element 150. Also, for example, the daylight blocking element 150 may be adjusted based upon its sensed heading. For example, if the sensed heading in combination with one or more additional parameters as described herein indicate that the sun is likely directly in view of a light opening selectively covered by the daylight blocking element 150 and the daylight level is likely intense, the daylight blocking element 150 may be adjusted to diffuse and/or block the entirety of the light output opening.

The control system also includes a location sensor 114 and a date and time sensor 116. In some embodiments the daylight mimicking lighting fixture 130 includes sensors 114, 116 and the daylight blocking element 150 includes separate sensors 114, 116. In other embodiments the daylight mimicking lighting fixture 130 and the daylight blocking element 150 may share one or more sensors 114, 116. For example, the sensors 114, 116 may be included separately coupled to a controller 110. The location sensor 114 determines geographic location. The location sensor 114 may include, for example, a pre-programmed geographic location stored in memory (e.g., programmed at the factory for a particular geographic region), a Global Positioning System (GPS) unit, and/or an internal or external geolocation apparatus (e.g., a nearby device that has geographic sensing capabilities (e.g., a smartphone) that may transmit geographic location via wired or wireless communications, and/or an internal or external network that may utilize an IP address, GSM antenna towers, and/or MTS cellular technology to determine a geographic location). The time and date sensor 116 may include, for example, an external or internal clock that may optionally be updated based on geographic location information (e.g., to determine appropriate time zone and/or switch to daylight savings time). In some embodiments the sensors 112, 114, and/or 116 may only be activated upon initial power up, after a reset, at certain intervals, and/or after a user queue via a user interface to conserve energy.

The control system also includes climate-based daylight models 118. The climate-based daylight models 118 may include, for example, climate-based daylight modeling (CBDM) data that predicts various radiant or luminous quantities (e.g., irradiance, illuminance, radiance, and luminance) using sun and sky conditions derived from meteorological datasets for a particular location. The climate-based daylight models 118 may additionally or alternatively include clear sky algorithms developed by the American Society of Heating, Refrigeration, and Air-Conditioning (ASHRAE). The climate-based daylight models 118 may be stored in memory and/or received or updated from an external data source. For example, the climate-based daylight models 118 may be received via a wired or wireless connection to a remote server. Also, for example, the climate-based daylight models 118 may be received from one or more other light sources generating data encoded light output.

As described herein, the light output generated by the daylight mimicking lighting fixture 130 and/or the amount of daylight blocked and/or diffused by the daylight blocking element 150 may be dependent at least in part upon the climate-based daylight models 118. For example, the color temperature and intensity of the light output of the daylight mimicking lighting fixture 130 may be based upon historical daylight color and/or intensity data from climate-based daylight models 118. For example, such data may be utilized in combination with one or more additional parameters described herein to identify a likely color and/or intensity of any generated sunlight that would be transmitted through the daylight mimicking lighting fixture 130 were it an actual light transmitting element directly exposed to the exterior. The color temperature and/or intensity of the light output may thus be adjusted to mimic likely actual conditions. Also, for example, the daylight blocking element 150 may be adjusted based upon the climate-based daylight models 118. For example, such data may be utilized in combination with one or more additional parameters described herein to identify a likely intensity of any generated sunlight that would likely be transmitted through a light opening covered by the daylight blocking element 150 and the daylight blocking element 150 may be adjusted accordingly.

The control system also includes a link to short-term weather-based information 120. The short-term weather-based information 120 may include transmitted short-term weather data for a particular location and/or geographic region. For example, the short-term weather-based information 120 may include weather information from a local weather station such as whether cloudy conditions, partly cloudy conditions, and/or sunny conditions are likely in the short-term for a location that includes the elements 130 and/or 150. Such conditions may be determined based upon, for example, daylight sensors, radar, and/or manually inputted data. Also, for example, the short-term weather-based information 120 may include weather information for one or more remote locations such as whether current conditions at the remote location are cloudy, partly cloudy, and/or sunny in combination with wind strength and direction. Also, for example, the short-term weather-based information 120 may include weather information for one or more remote locations such as the luminance level at the remote locations.

Based on such short-term weather-based information 120 information, it may be determined (either remotely or at the control system) if cloudy, partly cloudy, and/or sunny conditions are likely at a future time and/or what expected luminance values are at a future time. For instance, if weather data a mile west of a location of lighting fixture 130 and/or daylight blocking element 150 indicates a cloud has just blocked the sun and the wind direction is to the east at ten MPH, it may be determined that the cloud will likely block the sun at the location in approximately six minutes. In some embodiments the lighting fixture 130 and/or daylight blocking element 150 may proactively adjust one or more characteristics prior to the future weather-based change. For example, if the daylight blocking element 150 includes blinds, it may slowly open the blinds prior to the sun being completely blocked in anticipation of reduced daylight levels. In some embodiments the opening of blinds may be done gradually over a period of time so as to minimize noticeability of the change to individuals. For instance, the blinds may be slowly adjusted over the course of 45 seconds before the anticipated reduction in daylight level. Also, in some embodiments, the lighting fixture 130 may gradually adjust light output characteristics over a period of time so as to minimize noticeability of the change to individuals. For instance, the light output intensity of the lighting fixture 130 may be slowly decreased over the course of 45 seconds before the anticipated reduction in daylight level to mimic actual daylight conditions. Also, for example, other lighting fixtures may have light output proactively increased over the course of 45 seconds before the anticipated reduction in daylight in order to maintain desired illumination levels in an interior area to compensate for lesser illumination from natural light sources and/or mimicked light sources. Also, for example, lighting fixtures that are adjacent a daylight blocking element 150 may have their light output proactively dimmed during anticipated sunny periods to accommodate increased natural light entry into the interior area via the opening covered by the daylight blocking element 150. In some embodiments the short-term weather-based information 120 may include weather related events for a location that will occur in five minutes or less. In some embodiments short-term weather-based information 120 may include data from several surrounding geographic locations that may be selectively utilized depending on wind direction and/or speed.

The control system also includes a location-based daylight parameter calculation module 125 and a controller 110. Location-based daylight parameter calculation module 125 utilizes data from inputs 112, 114, 116, 118, and/or 120 to determine appropriate light output characteristics of daylight mimicking lighting fixture 130 and/or appropriate light blocking and/or diffusing characteristics of daylight blocking element 150. Controller 110 appropriately adjusts the one or more characteristics of daylight mimicking lighting fixture 130 and/or daylight blocking element 150. Controller 110 may optionally communicate with a driver of daylight mimicking lighting fixture 130 that controls a light source thereof and/or a motor or other actuator that controls a shade, optic, or other element. Controller 110 may optionally communicate with a motor or other actuator of daylight blocking element 150 that controls one or more aspect thereof. In some embodiments daylight mimicking lighting fixture 130 and daylight blocking element 150 may each have a controller 110. In some embodiments module 125 may be incorporated in controller 110.

Figure 4:
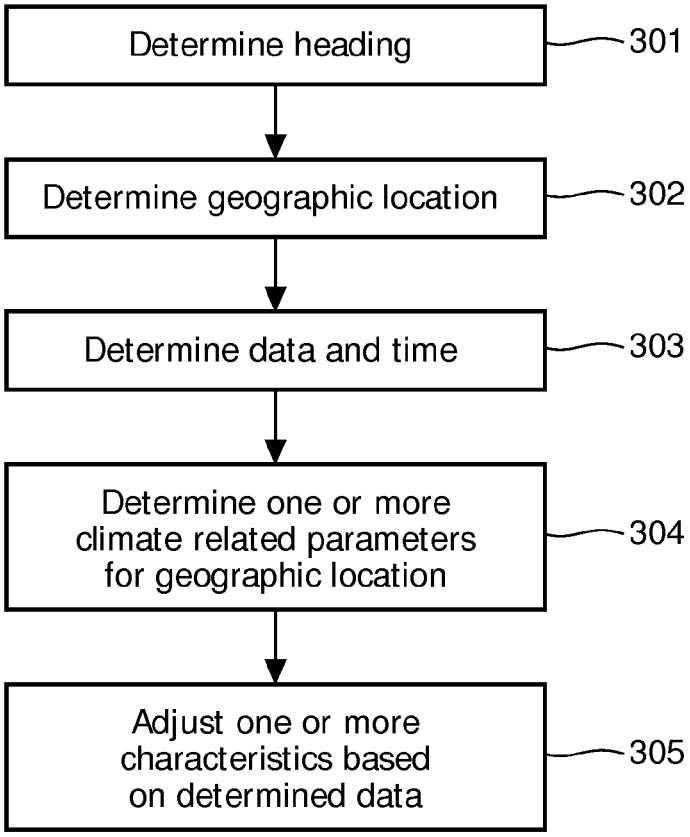
FIG. 4 illustrates a flowchart of adjusting one or more characteristics of a daylight blocking element and/or a daylight mimicking lighting fixture based on determined data.

The module 125 may determine an appropriate light output for daylight mimicking lighting fixture 130 and/or appropriate daylight blocking and/or diffusing for daylight blocking element 150 based on one or more data values and one or more algorithms. For example, as illustrated in FIG. 4, at step 301 the module 125 may determine heading 301, determine geographic location at step 302, determine the date and time at step 303, and determine one or more climate-related parameters for the geographic location at step 304. In some embodiments one or more of these values may be electronically provided via memory, one or more sensors, a clock, and/or a communications link to external data. The climate-related parameters may include the stored climate-based daylight models 118 and/or the short-term weather-based information 120. For example, the module 125 may utilize historic luminance values obtained from climate-based daylight models 118 and adjust those values upward or downward dependent upon cloud cover information from short-term weather-based information 120.

The module 125 may then utilize one or more of the received parameters from steps 301-305 to determine location-based daylight parameters such as likely daylight being transmitted through a light opening covered by daylight blocking element 150 and/or likely characteristics of daylight that should be transmitted by daylight mimicking lighting fixture 130. Once location-based daylight parameters have been determined, the module 125 may communicate such parameters to controller 110. Based on the parameters, the controller 110 may then adjust one or more characteristics of the lighting fixture 130 and/or daylight blocking element 150 at step 305 if necessary. As discussed, in some embodiments the characteristics of the lighting fixture 130 and/or daylight blocking element 150 may be adjusted based on the heading, pitch, and/or yaw of the element 130 and/or 150. For example, the light output of the lighting fixture 130 may have a beam direction, intensity, color temperature, and/or thermal temperature that is determined at least in part by the heading, pitch, and/or yaw of the element 130. For example, if it is determined the sun is in the east, a west facing lighting fixture 130 may have more diffuse lighting characteristics and an east facing lighting fixture 130 may have less diffuse lighting characteristics. Also, for example, the daylight blocking element 150 may have one or more louvers, shades, and/or diffusers whose deployment and/or orientation is determined at least in part by the heading, pitch, and/or yaw of the element 150. For example, if it is determined the sun is in the east, a west facing daylight blocking element 150 may not block any natural light and an east facing daylight blocking element 150 may block and/or diffuse a majority of the natural light.

Figure 3:
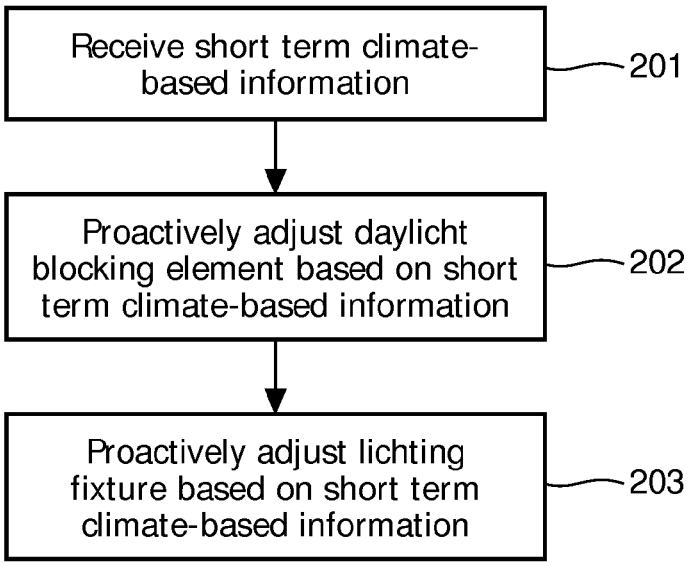
FIG. 3 illustrates a flowchart of proactively adjusting a daylight blocking element and/or a daylight mimicking lighting fixture based on short-term weather-based information.

Also, for example, as illustrated in FIG. 3, at step 201 the module 125 may receive short-term weather-based information and determine one or more location-based daylight parameters for the geographic location. The location-based daylight parameters may be based at least in part on the short-term weather-based information 120 received at step 201. For example, the module 125 may utilize daily patterns of the sun and annual orbit of the sun in combination with a determined date, time, and/or location to identify a likely actual direction and/or intensity of daylight, then modify that number based on short-term weather-based information 120 (e.g., anticipated short-term cloud cover data, anticipated short-term brightness level data). Once the climate-related parameters have been determined, the module 125 may communicate such parameters to controller 110. Based on the parameters, the controller 110 may then proactively adjust one or more characteristics of the lighting fixture 130 at step 202 and/or proactively adjust one or more characteristics of the daylight blocking element 150. For example, the diffuseness of the light output of lighting fixture 130 may be proactively adjusted in anticipation of extended cloud cover, thereby providing a realistic representation of actual exterior conditions. Also, for example, the degree of blocking and/or diffusing by the light blocking element 150 may be proactively adjusted to provide a less blocked transmission window in anticipation of extended cloud cover. In some embodiments the adjustments to elements 130 and/or 150 may proactively start and may also optionally be finished prior to or simultaneous with the anticipated future change in daylight. In some embodiments the adjustments to elements 130 and/or 150 may start at least 30 seconds prior to the anticipated future change in daylight and may also optionally occur over the course of at least 30 seconds. In some embodiments the adjustments may begin prior to the anticipated future change but not be completed until after the anticipated future change (optionally after verification of the anticipated change via, for example, an on-board daylight sensor).

In various embodiments the control system may present changes to a user prior to fully implementing the changes and provide the user with the option of affirming or denying those changes. For example, in some embodiments the control system may present a proactive change to a user and enable a user to halt the proactive change if desired. In some of those embodiments the proactive change may be gradual and the user may be able to stop the complete change during the gradual alteration before complete change has occurred.

Although only a single light blocking element 150 and daylight mimicking lighting fixture 130 are illustrated in FIG. 2, multiple lighting fixtures and/or light blocking elements may be provided in many embodiments. One or more of such multiple lighting fixtures and/or light blocking elements may optionally be controlled by a common master controller (with different configurations being sent to each element and/or common configurations being sent to one or more elements). Also, in some embodiments such multiple lighting fixtures and/or light blocking elements may optionally be networked. For example, in some embodiments multiple lighting fixtures may communicate via encoded lighting transmitted, for example, via pulse width modulation of one or more LEDs. One or more of the lighting fixtures and/or light blocking elements may optionally serve as a master for other lighting fixtures and/or light blocking elements in some embodiments. In some embodiments the lighting fixtures and/or light blocking elements may share detected information on location and/or orientation with other elements that do not have those detection means. In some embodiments the lighting fixtures and/or light blocking elements may share current lighting settings, planned lighting settings, and/or climate models in order to align the lighting effect among a multitude of elements so that a coherent effect can be created.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited. Also, reference numerals appearing in the claims in parentheses, if any, are provided merely for convenience and should not be construed as limiting the claims in any way.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. A method of controlling illumination in a space, comprising:

determining an orientation relative to the Earth's magnetic poles or about a nadir axis of a lighting fixture;

determining a geographic location of said lighting fixture;

determining at least one climate-related parameter for said geographic location; and adjusting at least one light output characteristic of said lighting fixture based on said orientation and said climate-related parameter.

2. The method of claim 1, wherein said at least one light output characteristic includes at least one of a light output direction and a light distribution shape of said lighting fixture.

3. A method of controlling illumination in a space according to claim 1, comprising:

receiving short-term weather-based information;

proactively determining, based on said short-term weather-based information, likely daylight conditions in an exterior space relative to said space at a future time; and beginning to adjust the at least one light output characteristic of said lighting fixture in correspondence with said likely daylight conditions prior to said future time.

4. The method of claim 3, wherein said short-term weather-based information includes daylight level related information from a location near said exterior space, wind strength, wind direction and cloud cover.

5. The method of claim 1, wherein said orientation relative to the Earth's magnetic poles or about a nadir axis is determined via an orientation sensor on said lighting fixture.

6. The method of claim 1, wherein said climate-related parameter includes short-term weather-based information.

7. The method of claim 6, further comprising proactively determining, based on said short-term weather-based information, likely daylight conditions in an exterior space relative to said space at a future time; and wherein said at least one light output characteristic of said lighting fixture is adjusted in correspondence with said likely daylight conditions prior to said future time.

8. The method of claim 1, further comprising determining at least one of a pitch and a yaw of said lighting fixture and wherein said at least one of a light output characteristic of said lighting fixture is adjusted in correspondence with said at least one of said pitch and said yaw.

9. The method of claim 8, wherein said adjusting step includes beginning to adjust said at least one light output characteristic of said lighting fixture at least thirty seconds prior to a future time.

10. A system for controlling illumination in a space, comprising:

an orientation sensor generating orientation data of at least one lighting fixture relative to the Earth's magnetic poles or about a nadir axis;

a geographic location source providing geographic location data;

a controller, said controller receiving at least one climate-related parameter for said geographic location; and a light source generating a light output, wherein said controller alters at least one light output characteristic of said at least one lighting fixture based at least in part on said orientation data and said climate-related parameter.

11. The system for controlling the illumination in a space of claim 10, wherein said at least one light output characteristic includes a light output direction and/or light output shape.

12. The system for controlling the illumination in a space of claim 10, wherein said climate-related parameter includes short-term weather-based information.

13. The system for controlling the illumination in a space of claim 10, wherein said orientation sensor is a three axis electronic sensor also generating at least one of pitch and yaw data.

14. The system for controlling the illumination in a space of claim 10, further comprising:

a daylight blocking element, wherein said controller further alters at least one light blocking characteristic of said daylight blocking element based at least in part on said orientation data and said climate-related parameter.

* * * * *